United States Patent [19]

Leliaert

[11] 4,176,502

[45] Dec. 4, 1979

[54] SPACERLESS BLASTING WHEEL AND BLADE LOCKING ARRANGEMENT THEREFOR

[75] Inventor: Raymond M. Leliaert, South Bend, Ind.

[73] Assignee: Wheelabrator-Frye Inc., Hampton, N.H.

[21] Appl. No.: 877,878

[22] Filed: Feb. 15, 1978

[51] Int. Cl.[2] ..... B24C 5/06

[52] U.S. Cl. ..... 51/434; 51/435

[58] Field of Search ..... 51/434, 435; 241/275; 416/214 R, 214 A, 220 R, 220 A

[56] References Cited

U.S. PATENT DOCUMENTS

| | | | |
|---|---|---|---|
| 1,263,448 | 4/1918 | McFarland | 416/214 R |
| 2,108,211 | 2/1938 | Rosenberger | 51/434 |
| 2,119,812 | 6/1938 | Hamren | 51/434 |
| 2,368,664 | 2/1945 | Keefer | 51/434 |
| 3,160,992 | 12/1964 | Moore | 51/434 |
| 3,383,804 | 5/1968 | Haider | 51/434 |
| 4,069,025 | 1/1978 | Macmillan | 51/434 |

FOREIGN PATENT DOCUMENTS

| | | | |
|---|---|---|---|
| 154599 | 4/1921 | United Kingdom | 416/214 A |
| 848562 | 9/1960 | United Kingdom | 416/214 A |

*Primary Examiner*—Garry L. Smith

*Attorney, Agent, or Firm*—McDougall, Hersh & Scott

[57] ABSTRACT

A blasting wheel for projecting particulate against a surface employs a blade lock arrangement which eliminates the need for securing the blade between a pair of plates separated by a spacer. Rather the blades are secured at only one end thereof by use of an improved locking arrangement. The locking arrangement employs a back plate containing a blade alignment channel and a securing element. The back plate is secured to the drive shaft by means of a hub. A front plate sandwiches one end of the blade between it and the back plate. The front plate is adjacent the back plate rather than spaced therefrom.

6 Claims, 9 Drawing Figures

SPACERLESS BLASTING WHEEL AND BLADE LOCKING ARRANGEMENT THEREFOR

BACKGROUND OF THE INVENTION

This invention relates to the field of blast treatment devices. More particularly, it relates to that class of devices which are capable of blast treatment by projecting particulate at high velocity against a part to be cleaned, deburred or otherwise treated. Typically this blast treatment is accomplished by the use of centrifugal throwing wheels which receive particulate at the center of the wheel and project it outwardly by use of a series of radially positioned blades. In the usual application the projected particulate causes wear on the surface of the blades which are replaceable at service intervals. This normal situation obtains when a control cage is employed for directing the blast in a particular direction to strike a target.

Recently it has become desirable to alter the construction and operation of the device somewhat to obtain certain objectives. In order to scrub sand used in foundry operations, it is often desirable to project the sand against a target and have it rebound therefrom through a stream of oncoming particles to, in effect, scrub the surface of the sand grains. This frees the sand of foundry binder and reduces the cost of the molding operation. When a blast wheel is used for this purpose it is used without a direction control cage and is referred to as a bare wheel assembly. Bare wheel assemblies utilize relatively high R.P.M. motors to maximize the scrubbing effect on the abrasive or sand being treated.

A particular problem which arises when a bare wheel assembly is utilized for blast treatment or sand srubbing is the heavy wear which occurs on the spacer elements provided in the standard blast wheel. Spacer elements are generally provided behind each blade in the wheel and, depending upon the design, serve one or more functions as follows. The blades are generally mounted in the wheel positioned between a front and back plate. The front and back plate are fastened to spacers. The side plates are spaced so that the blades may be removed when necessary without otherwise disassembling the wheel. In some constructions the spacers serve the additional purpose of securing the blade in the desired radial position. Exemplary of blades in which spacers are employed are the devices disclosed in U.S. Pat. Nos. 3,683,556 and 3,785,105.

As mentioned, when a bare wheel assembly is employed, that is, a wheel without a control cage, the particulate thrown travels in all directions and a portion of the particulate impinges upon the spacers causing them to wear excessively.

According to the present invention bare wheel assemblies are disclosed which eliminate the need for spacers and thereby obviates the problem of excess wear on those elements.

It is accordingly an object of the present invention to provide an improved blast wheel design which securely locks the throwing blades into a blast wheel without the use of spacers.

Another object of the invention is to provide an improved spacerless blast wheel which securely positions the throwing blades in the wheel.

Another object of the invention is to provide a blast wheel capable of securing blades to one side of the wheel in a desired angular orientation.

Other objects and advantages of the invention will be apparent from the remaining portion of the specification.

PRIOR ART STATEMENT

In accordance with the provisions of 37 CFR 1.97 et seq, applicant advises that the closest prior art references of which he is aware are U.S. Pat. Nos. 3,683,556, 3,785,105, 3,151,417, 3,197,920, and 3,241,266. These patents relate to centrifugal blasting wheels which comprise a plurality of radially positioned blades secured between a pair of end plates. Spacers separate the end plates and permit removal of individual blades for replacement.

DETAILED DESCRIPTION

Figure 1:
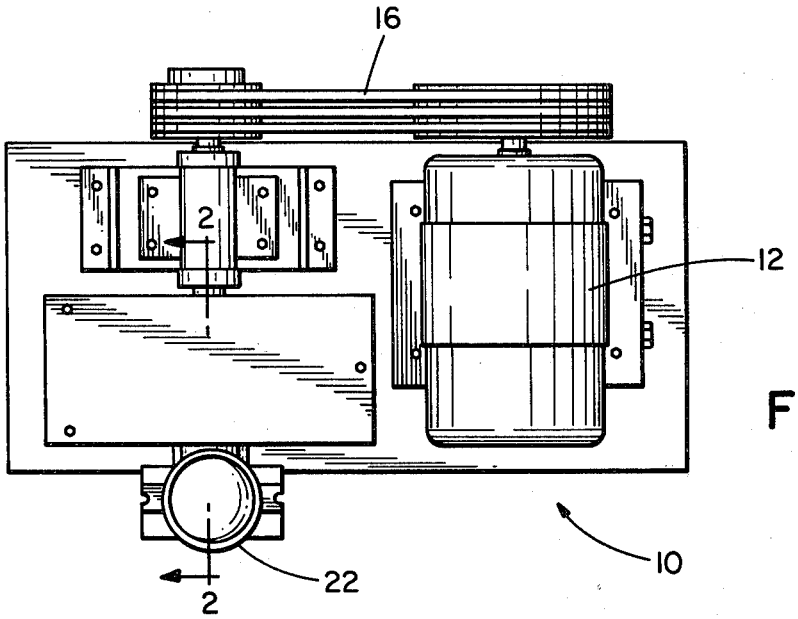
FIG. 1 is a plan view of a sand reclamation device employing a spacerless blasting wheel according to a first embodiment of the invention.
Figure 2:
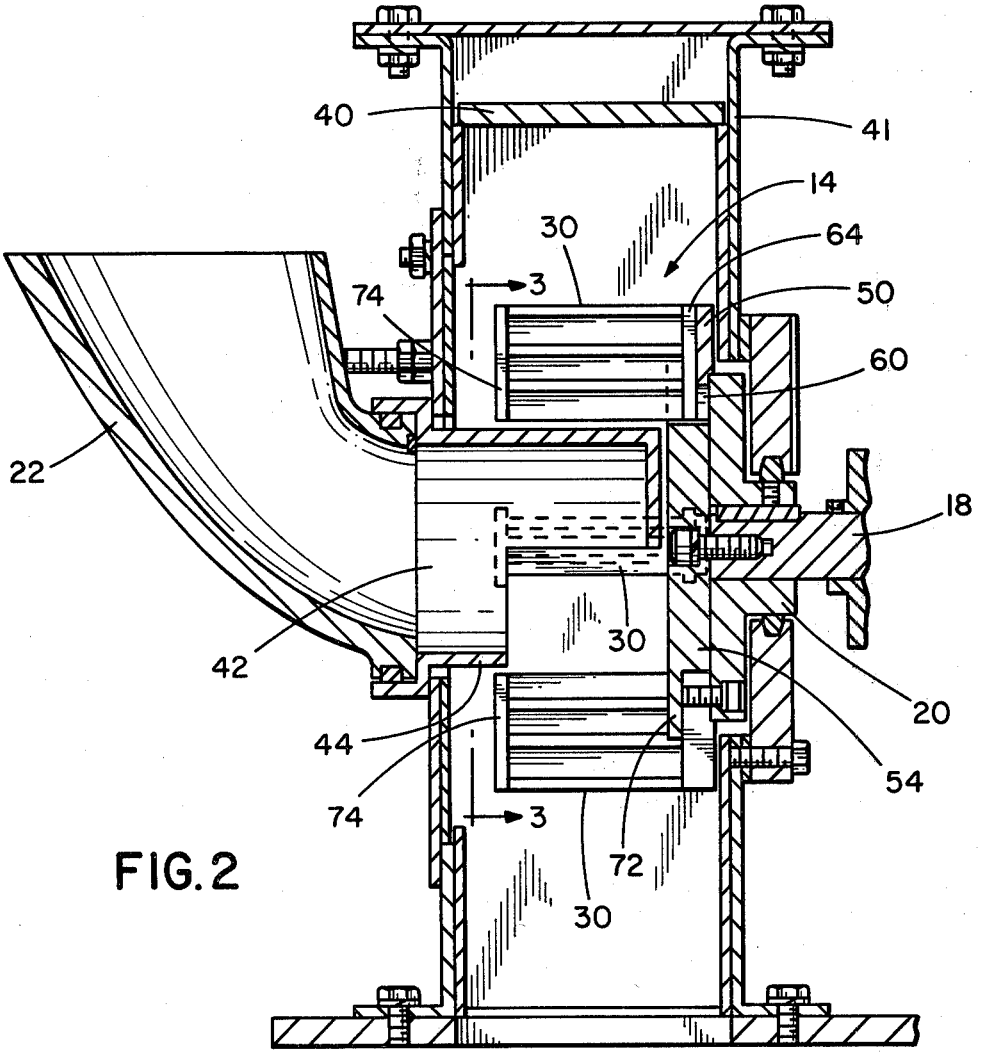
FIG. 2 is a sectional view along the lines 2—2 of FIG. 1 illustrating the details of the blast wheel according to the invention

Referring now to FIGS. 1 and 2, a sand reclamation device employing a blast wheel according to the invention is illustrated. The reclamation device 10 is driven by a motor 12 which is connected to the blast wheel 14 by pulley 16, shaft 18 and hub 20. When the motor is operational wheel 14 is rotated at high velocity. Sand to be treated is supplied to a feed spout 22 which conveys it to the center of the wheel where it passes downwardly, by force of gravity, into the path of the blades secured to the wheel.

Figure 3:
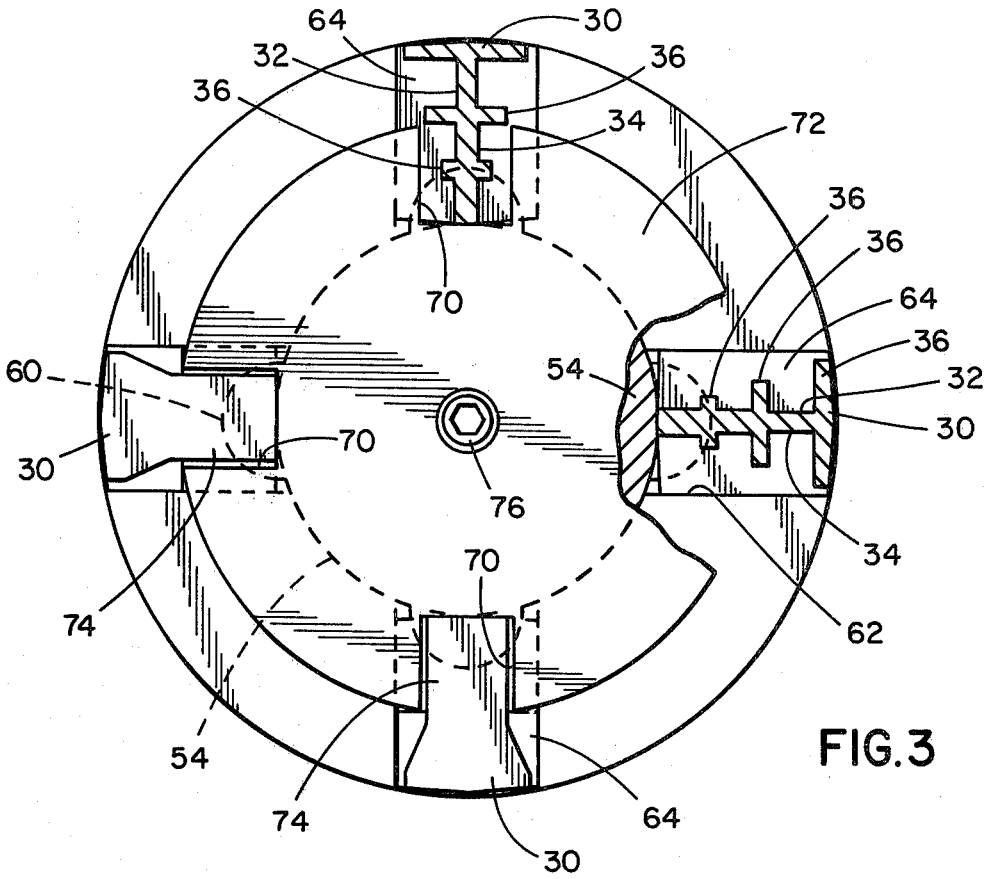
FIG. 3 is an end elevation along the lines 3—3 of FIG. 2

As indicated in FIG. 3, the wheel is illustrated as having four blades 30 secured thereto. It will be apparent to those skilled in the art that a greater or lesser number of blades can be provided, as desired. It should be further noted that the blades illustrated in the drawings are two sided, that is, the wheel may be rotated in either direction and particulate will be projected by one of blade faces 32 and 34. If desired, a blade having only a single face can be utilized. Furthermore, blade 30, as illustrated, is of a type having a series of vertically extending dams 36 to reduce wear on the blade face. It is, of course, possible to utilize the present invention with blades of ordinary construction which do not employ such dams.

The sand passing from the feed spout 22 onto the blades 30 is accelerated and thrown outwardly therefrom. By virtue of the sand being fed to the blades at the bottom of the device most of the sand is projected upwardly against a target 40 secured to sand scrubber housing 41. Sand is channelled from the feed spout 22 to the blades 30 by a tubular element 42 having an opening at its lower periphery 44 so that the sand drops downwardly onto the blades as it is fed from the spout.

Figure 4:
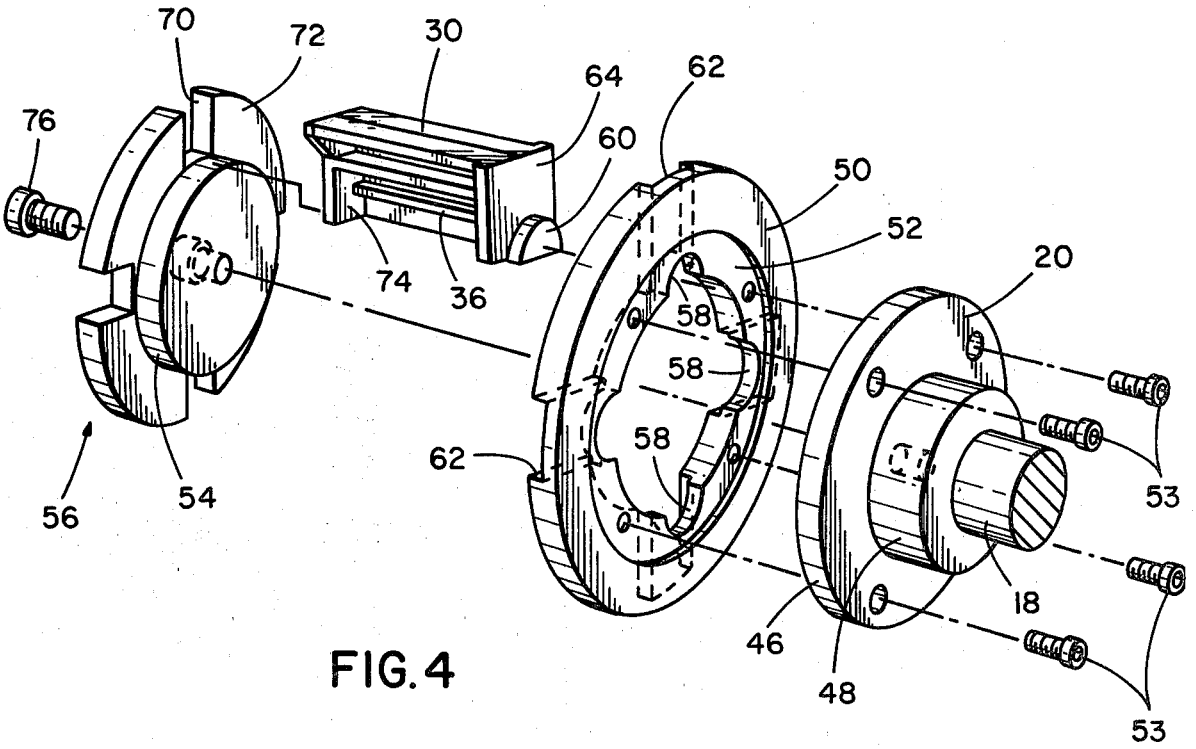
FIG. 4 is an exploded view of the blade assembly.

With reference to FIG. 4, a first blade construction and the locking device is illustrated. Shaft 18 is secured to the hub 20 in an appropriate manner as by set screws provided in the hub. Hub 20 consists of two connected cylindrical elements, an outer element 46 and an inner element 48. Shaft 18 is secured to the inner cylinder 48 while the outer cylinder 46 is received in a back plate 50. Back plate 50 is a cylindrical element having a recess 52 of a diameter corresponding to that of element 46. Thus, the back plate can be secured to the hub by mating the two elements and securing them with screws 53 in a conventional manner.

The back plate is also provided with a generally circular opening therethrough to receive an inner cylindrical portion 54 of a front plate 56. An additional portion of the back plate is cut out or notched as at 58 to receive a securing element 60 provided on the blade 30. In the embodiment illustrated in FIG. 4 cut outs 58 are semicircular or crescent shaped and the securing element 60 is similarly configured whereby element 60 is receivable in the cut out 58. In this manner the blade is secured to the back plate 50 against outward movement due to rotational forces.

In order to maintain correct radial positioning of the blades, it is necessary to provide means for aligning the blades. For that purpose the back plate is further provided with an alignment channel 62 on the side thereof opposite the recess 52. The alignment channel is generally rectangular in configuration, according to a first embodiment, and dimensioned to receive blade end 64 therein.

The back plate 50, by virtue of notches 58 and channels 62, is capable of receiving a blade, such as blade 30, and locking and correctly positioning it for operation. This is accomplished by positioning the blade so that securing element 60 is in notch 58, thereby preventing outward movement of the blade and positioning blade end 64 in the alignment channel 62 thereby insuring correct angular orientation of the blade. The front plate 56 secures the blade against the back plate as will be described.

As indicated in the background portion of the specification, it is highly desirable in sand scrubbers or similar applications to eliminate the need for spacers and bolts to secure a front plate on the other side of the blade. According to the present invention the front plate 56 is secured flush against the back plate 50. The front plate is provided with a set of notches 70 in the outer cylindrical portion 72 thereof. These notches correspond in number to the number of blades which the wheel will carry and in dimension to the dimension of the blade end 74. As best seen in FIG. 3, blade end 74 is of smaller dimensions than blade end 64. Thus, the front plate is passed over blade end 74 and moved toward the back plate 50 until the outer member 72 engages the inner surface of blade end 64. The front plate is then secured to the hub 20 as by bolt 76 to lock the blades to the back plate. In this manner the blade is secured at only one end thereof and the need for spacers or other structure in the blasting area of the wheel is eliminated.

Figure 5:
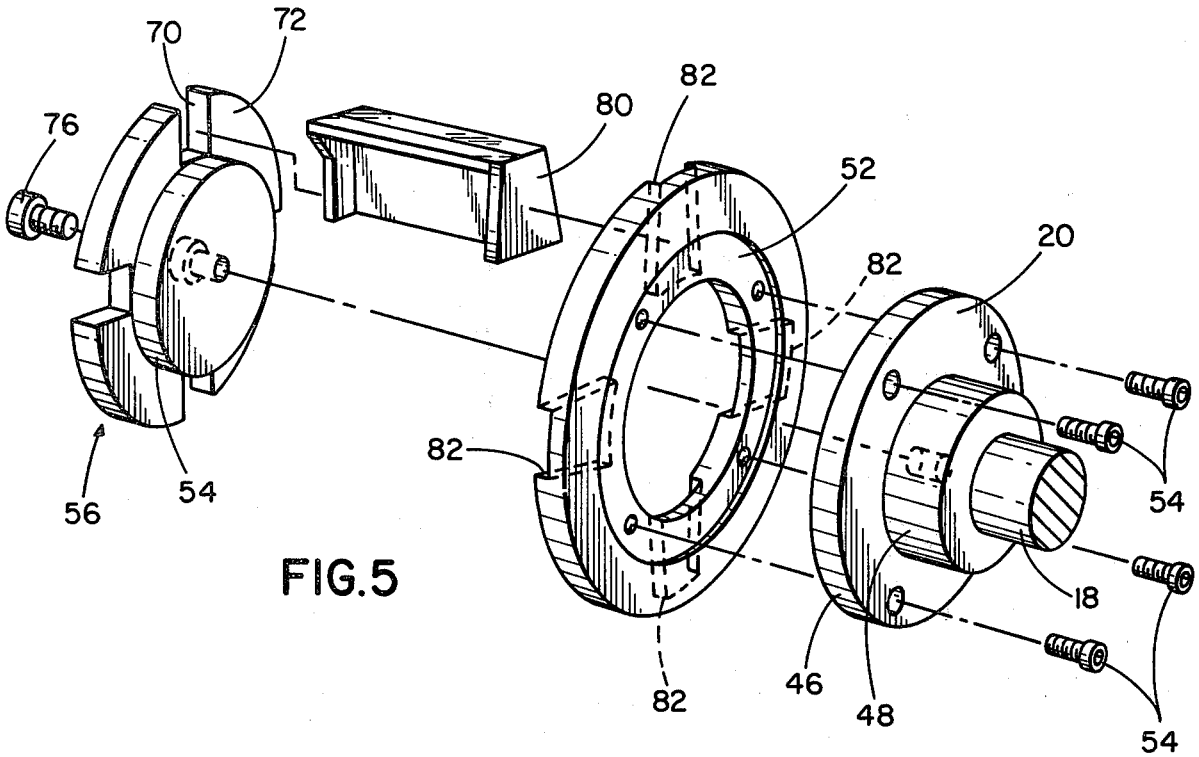
FIG. 5 is an exploded view of a second embodiment of the invention.
Figure 6:
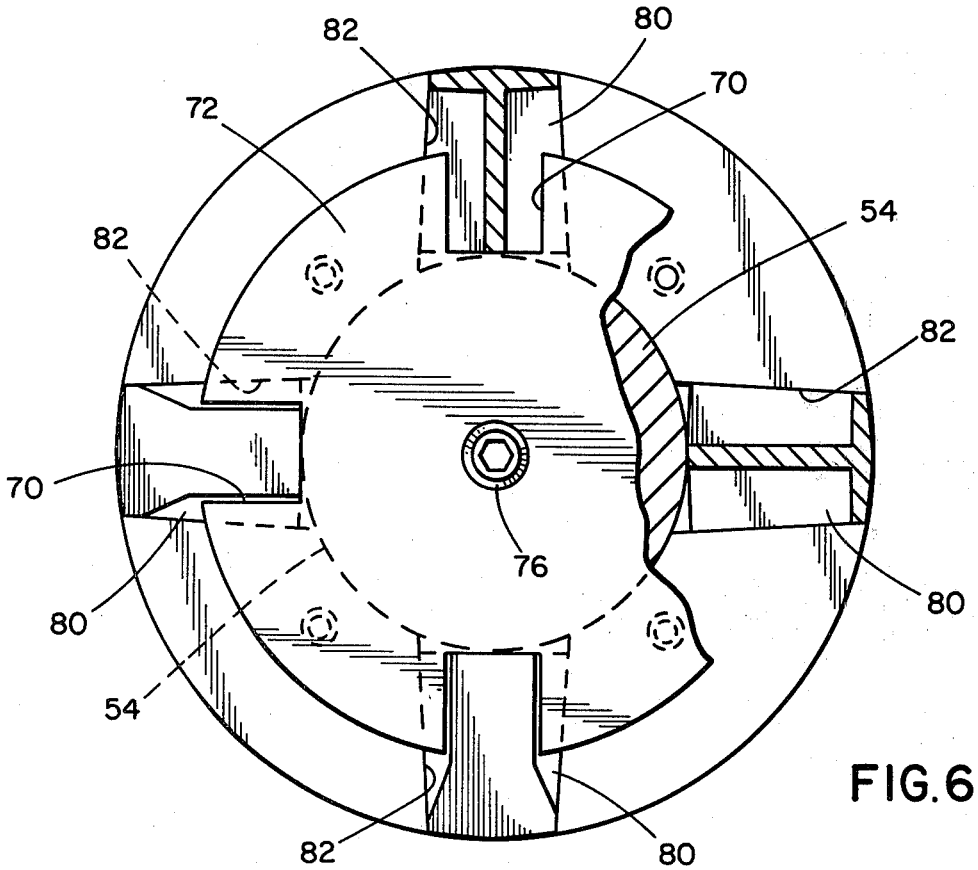
FIG. 6 is a view similar to FIG. 3 but of the second embodiment of the invention.

Referring now to FIGS. 5 and 6, a second embodiment of the invention is disclosed. Those elements which are unchanged carry the same numerical designation. The second embodiment differs from the first in the manner in which the blade is secured to the back plate. In the first embodiment a blade securing element 60 is received in a notch 58. In the second embodiment this securing element is eliminated. Its function is instead achieved by altering the configuration of the alignment channel and the blade end. As indicated in FIG. 5, the blade end 80 is not rectangular in shape, rather it tapers at its top to form a portion of a triangle. The alignment channel 82 is similarly tapered so that the channel is wider at the bottom than at the top and corresponds in dimension to that of the blade end. In this manner the blade end is receivable in the channel which now serves a dual function of maintaining the blade in correct radial alignment and securing the blade against outward movement due to the rotation of the wheel. In all other respects this embodiment is the same as the first embodiment, the blade being secured to the back plate by means of the front plate compressing it against the back plate.

In both illustrated embodiments the end of the blade remote from the back plate is unattached to any structure. The blades positioning is such that they clear the feed elements 42, 44 as illustrated in FIG. 2.

Figure 7:
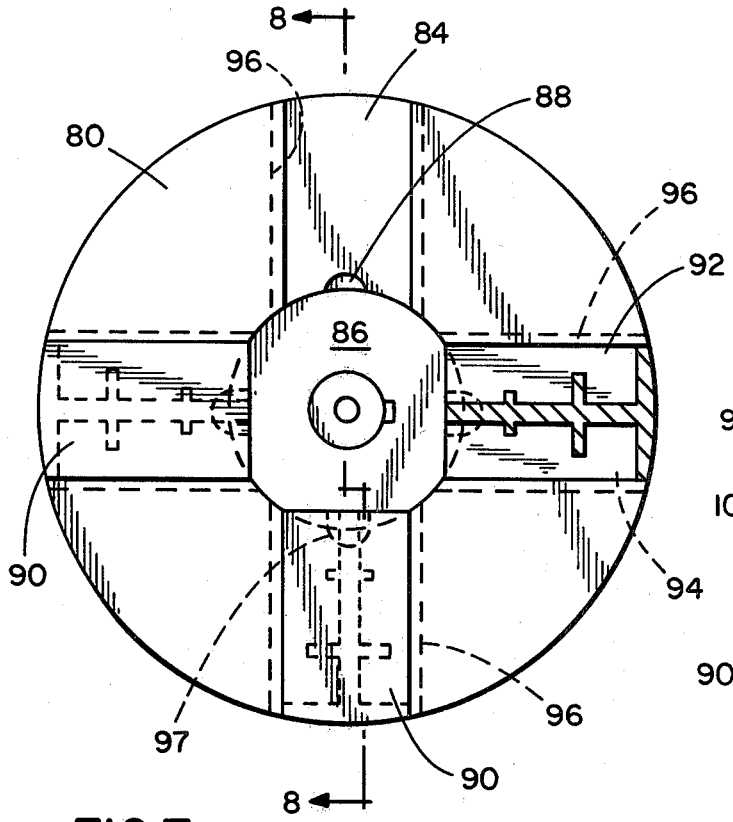
FIG. 7 is a front elevational view of a third embodiment of the invention.
Figure 8:
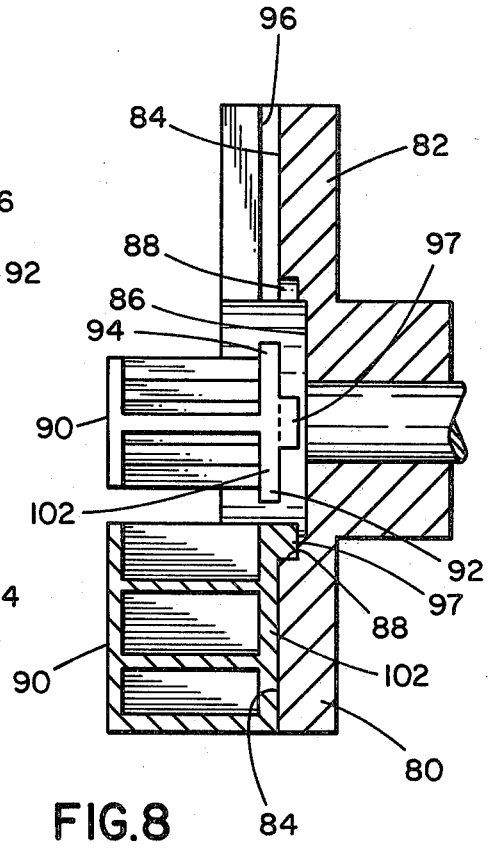
FIG. 8 is a sectional view along the lines 8—8 of FIG. 7.
Figure 9:
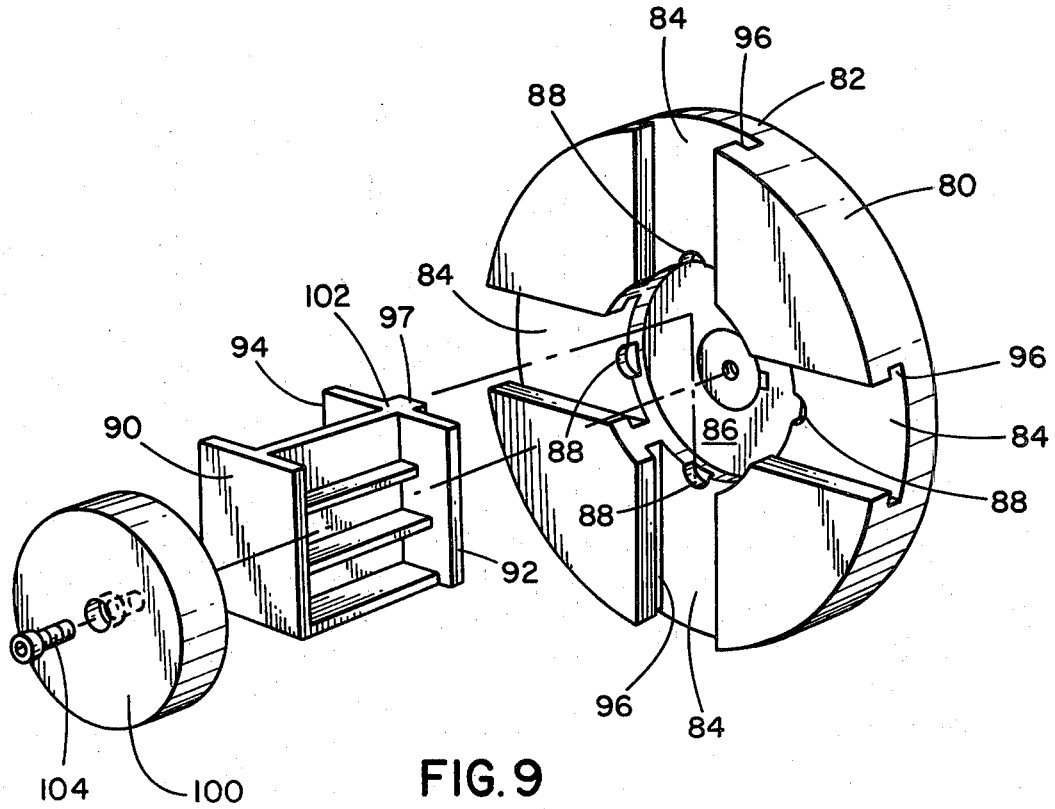
FIG. 9 is an exploded view of the third embodiment.

Referring now to FIGS. 7 through 9, a third embodiment of the invention is disclosed. In this embodiment a one sided wheel is provided wherein the blades are inserted from the center and held in position by centrifugal force. A back plate 80 is provided which is adapted to be secured to a hub 82 as with the previous embodiments. Hub 82 is provided with a plurality of T-shaped channels 84 equally spaced around its circumference, one for each location where a blade is to be received in the back plate. Each channel 84 extends radially inwardly and terminates in a depressed central portion 86. Provided at the ternination of the slot 84 is a recess 88 which may be crescent-shaped or other shape as desired.

Insertion of the blade is accomplished by placing the blade into the central portion of the back plate and then engaging the edges 92 and 94 of the blade in the recessed portion 96 of the T-shaped channel 84. The blade is then passed radially outwardly from the center of the back plate until the recess 88 engages the similarly shaped element 97 provided on the end of the blade. By cooperative engagement of the blade edges 92 and 94 with the recessed portion 96 of the T-shaped channel and element 97 being engaged in recess 88 the blade is secured in postion during rotation. The advantage of this design over the preceding embodiments is that the blade 90 can be inserted and removed from the central portion 86 of the back plate and thus it is possible to change blades without removing the entire assembly from a blast housing such as the housing illustrated in FIG. 2.

When the back plate is not rotating there is the possibility of a blade slipping towards the center by force gravity. In order to prevent this from happening, a center plate plug 100 may be provided as shown in FIG. 9. This plate is dimensioned to fit in the central portion 86 of the back plate. The front plate is secured by a bolt 104 into a tapped hole in shaft 18 or by well known methods.

While I have shown and described embodiments of this invention in some detail, it will be understood that this description and illustrations are offered merely by way of example, and that the invention is to be limited in scope only by the appended claims.

I claim:

1. A spacerless blasting wheel construction for rotation by a motor driven shaft comprising:

(a) a plurality of blades for projecting particulate, one end thereof being provided with a securing element thereon, (b) means for engaging said shaft for rotation therewith, (c) means for securing said blades to said shaft engaging means at said one end only, said blades maintained at a selected location and angular orientation by said securing means, said securing means including a front plate and a back plate, said plates being positioned on opposite sides of said one end of said blade to sandwich said one end therebetween, said front plate being secured to said shaft engaging means flush against said back plate, said back plate having a central recess and slots located at the outer periphery of said central recess into which said blade securing elements are received to prevent outward movement thereof, said blades rotating with said shaft to project particulate outwardly therefrom, the other end of said blades remaining unsecured.

2. The device according to claim 1 wherein said engaging means includes a hub and means for attaching said hub to said shaft.

3. The device according to claim 1 wherein said orientation maintaining means includes an alignment channel provided in said back plate receiving said one end of said blade therein.

4. The device according to claim 1 wherein said blades are two sided for rotation in either direction.

5. The device according to claim 1 wherein said securing element is a crescent-shaped and secured to said one end of said blade.

6. A spacerless blasting wheel construction for rotation by a motor driven shaft comprising:

(a) a hub including means for securing said hub to said shaft, (b) a plurality of blades for projecting particulate, one end of each blade being provided with a raised securing element thereon.

(c) a back plate secured to said hub for rotation therewith, said back plate including:

(i) a plurality of T-shaped channels each channel adapted to receive and radially align one end of a blade therein, (ii) a central recess for permitting said blades to be inserted and removed from said channels, (iii) means for securing said blades in position in said channels against radially outward movement during rotation of said wheel, said means being located at the outer periphery of said central recess and comprising a complimentary shaped recess adapted to engage said raised element when said blades are in position in said channel thereby to prevent outward movement of said blades, (d) a front plate releasably secured to said back plate and receivable in said central recess to prevent radially inward movement of said blades when said wheel is not rotating.

* * * * *